United States Patent [19]

Tanaka et al.

[11] Patent Number: 4,853,504

[45] Date of Patent: Aug. 1, 1989

[54] TRIPLE ACTION PRESSURE SWITCH APPARATUS

[75] Inventors: Hazime Tanaka, Yokohama; Hirayoshi Suzuki, Hadano; Keiji Sasaki, Tokyo, all of Japan

[73] Assignee: Fuji Koki Manufacturing Co., Ltd., Tokyo, Japan

[21] Appl. No.: 222,720

[22] Filed: Jul. 21, 1988

[30] Foreign Application Priority Data

Jul. 23, 1987 [JP] Japan ..... 62-182386

[51] Int. Cl.[4] ..... H01H 35/34

[52] U.S. Cl. ..... 200/83 P; 200/82 R; 200/81.4; 200/83 J

[58] Field of Search ..... 200/81 R, 81.4, 81.5, 200/83 R, 83 J, 83 P, 83 Q, 83 S, 83 W, 82 R; 340/626; 92/5 R, 98 R, 101; 73/861.47, 717, 723, 744, 745; 307/118

[56] References Cited

U.S. PATENT DOCUMENTS

| | | | |
|---|---|---|---|
| 4,296,287 | 10/1981 | Boulanger et al. | 200/83 P |
| 4,400,601 | 8/1983 | Brucken | 200/81.4 |
| 4,473,729 | 9/1984 | Ting et al. | 200/83 Z |
| 4,591,677 | 5/1986 | Hirota et al. | 200/83 J |
| 4,593,166 | 6/1986 | Hirota et al. | 200/83 J |
| 4,757,165 | 7/1988 | Marcoux | 200/83 P |

FOREIGN PATENT DOCUMENTS 58-169636 12/1983 Japan .

59-82936 5/1984 Japan .

*Primary Examiner*—Gerald P. Tolin

*Attorney, Agent, or Firm*—Brown, Martin, Haller & McClain

[57] ABSTRACT

A triple action pressure switch apparatus includes a housing having a pressurized fluid introducing path, the inner space of which is partitioned into a pressure actuating chamber communicated with the path and a switch mechanism storage chamber by a diaphragm. In the latter chamber, a third snap disc assembly, a first piston, a second snap disc assembly, a second piston, a first snap disc assembly, and first and second switches are arranged from the diaphragm in this order in a longitudinal direction of the housing. When the pressure of the pressurized fluid reaches a lower limit of a certain range of value, the first disc is transformed to set the first switch in one of ON and OFF states. When the pressure of the pressurized fluid reaches an upper limit of the range, the second disc is transformed to move a first tubular rod slidably inserted in the second piston and the first disc. Such movement of the first rod set the first switch in the other of ON and OFF states. When the pressure of the pressurized fluid reaches a predetermined value in the range, the third disc is transformed to move a second rod slidably inserted in the first piston, second disc, and the central hole of the first rod. Such movement of the second rod set the second switch in one of ON and OFF states.

20 Claims, 4 Drawing Sheets

TRIPLE ACTION PRESSURE SWITCH APPARATUS

BACKGROUND OF THE INVENTION

1. Field of the Invention

The present invention relates to a triple action pressure switch apparatus comprising a first switch means which is set in one of ON and OFF states when a pressure of a pressurized fluid is set to fall within a predetermined range, and is set in the other one of the ON and OFF states when the pressure of the pressurized fluid is decreased below the lower limit of the predetermined range or is increased over the upper limit of the predetermined range, and a second switch means which is set in one of ON and OFF states when the pressure of the pressurized fluid is set to be higher than a predetermined value within the predetermined range, and is set in the other one of the ON and OFF states when the pressure of the pressurized fluid is set to be lower than the predetermined value.

2. Description of the Related Art

The triple action pressure switch apparatus described above is used in, e.g., an automotive air conditioner. The first switch means of the triple action pressure switch apparatus is connected to an electrical circuit for a compressor or an electrical circuit for an alarm of the air conditioner, and the second switch means is connected to an electrical circuit for a fan motor of a condenser of the air conditioner.

When the pressure of a coolant in the automotive air conditioner is increased over the upper limit of an appropriate predetermined range or is decreased below its lower limit, the first switch means turns off the electrical circuit for the compressor or turns on the electrical circuit for the alarm. When the pressure of the coolant is increased over a predetermined value within the predetermined range, the second switch means turns on the electrical circuit for the fan motor of the condenser.

The fan motor for the condenser is important for an air conditioner of a compact front-wheel drive vehicle in which an installation space of the condenser is limited, and when an outlet pressure of the coolant is increased and the temperature upon delivery of the coolant is increased, the heat exchanging power of the condenser tends to be short.

Triple action pressure switch apparatuses as described above have already been known in Japanese Utility Model Disclosure (Kokai) No. 59-82936 and U.S. Pat. No. 4,591,677. Each of the triple action pressure switch apparatuses described in the above utility model and patent employs one compression coil spring and two snap discs. The compression coil spring is employed to turn on/off the first switch means at the lower limit of the predetermined range. One snap disc is used to turn off/on the first switch means at the upper limit of the predetermined range. The remaining snap disc is used to turn on/off the second switch means at the predetermined value within the predetermined range.

In these conventional triple action pressure switch apparatuses using the compression coil spring, when the pressure of the coolant does not reach the lower limit of the predetermined pressure and a vibration acts on these conventional apparatuses, expansion/contraction of the compression coil spring due to the vibration may cause an erroneous operation of these conventional apparatuses at the lower limit of the predetermined range.

The compression coil spring sensitively causes chattering in response to a variation in pressure of the coolant near the lower limit of the predetermined range. Since the chattering exert a bad influence on an electronics apparatus located near the pressure switch, the chattering must be prevented. In particular, an electronics apparatus for controlling the action of an internal combustion engine must be prevented from being exerted a bad influence by the chattering produced at the pressure switch in the automotive air conditioner.

The compression coil spring requires a large actuating space in its axial direction. This space makes the axial size of the conventional triple action pressure switch apparatus relatively large.

It is difficult for the compression coil spring to set a free length or spring coefficient in its manufacturing process with high precision. For this reason, the coil spring requires a screw type biasing-force adjusting means. The screw type biasing-force adjusting means makes the structure of the triple action pressure switch apparatus complicated and bulky. In addition, although an operation for setting a predetermined preload in the compression coil spring is cumbersome, precision that can be possibly achieved by the setting operation is not so high.

SUMMARY OF THE INVENTION

The present invention has been made in consideration of the above situation, and has as its object to provide a triple action pressure switch apparatus which employs three snap disc means in order to eliminate the conventional drawbacks in the triple action pressure switch apparatus utilizing a combination of the compression coil spring and the snap discs, and can achieve simple structure and easy assembly.

The above object of the present invention is achieved by a triple action pressure switch apparatus including first switch means which is set in one of ON and OFF states when a pressure of a pressurized fluid is set within a predetermined range, and is set in the other of the ON and OFF states when the pressure of the pressurized fluid is decreased below a lower limit of the predetermined range and is increased over an upper limit of the predetermined range, and second switch means which is set in one of the ON and OFF states when the pressure of the pressurized fluid is set to be larger than a predetermined value within the predetermined range, and is set in the other of the ON and OFF states when the pressure of the pressurized fluid is decreased below the predetermined value, comprising: a housing having an inner space and a path for introducing the pressurized fluid into the inner space; a diaphragm which is provided in the inner space s that the inner space of the housing is partitioned into a pressure actuating chamber communicating with the pressurized fluid introduction path and a switch mechanism storage chamber blocked from the pressurized fluid introduction path in a sealed state; a first piston member which is arranged adjacent to the diaphragm in the switch mechanism storage chamber, and is moved together with a central portion of the diaphragm in a moving direction of the central portion when the central portion is moved upon movement of the diaphragm; a second piston member which is arranged adjacent to the first piston member at a side farther from the diaphragm in the switch mechanism storage chamber, and is moved together with the first piston member in a moving direction of the first piston member when the first piston member is moved upon deformation of the diaphragm; first snap disc means which is arranged adjacent to a side surface of the second piston member farther from the first piston member in the switch mechanism storage chamber, a peripheral portion of which is supported by a peripheral surface of the switch mechanism storage chamber so as not to be moved away from the diaphragm in the moving direction of the second piston member, and which is transformable with a snap action between a first configuration wherein its central portion projects toward the diaphragm to cause the second piston member to move close to the diaphragm and a second configuration wherein its central portion projects in a direction away from the diaphragm to cause the second piston member to be moved inwardly in the moving direction in the switch mechanism storage chamber; second snap disc means which is interposed between the second and first piston members, and is transformable with a snap action between a first configuration wherein its central portion projects toward the first piston member and a second configuration wherein its central portion projects in a direction away from the first piston member; third snap disc means which is interposed between the first piston member and the diaphragm and is transformable with a snap action between a first configuration wherein its central portion projects toward the diaphragm and a second configuration wherein its central portion projects in a direction away from the diaphragm; a first actuating rod which is inserted in the second piston member and the first snap disc means to be movable in the moving direction of the second piston member and is moved in the moving direction upon transformation of the second snap disc means between the first and second configurations; and a second actuating rod which is inserted in the first piston member, the second snap disc means, the second piston member, and the first snap disc means to be movable in the moving direction of the first piston member, and is moved in the moving direction upon transformation of the third snap disc means between the first and second configurations.

In the triple action pressure switch apparatus of this invention, which is so constructed as described above, the first snap disc means is in the first configuration until the pressure of the pressurized fluid transmitted through the diaphragm and the first and second piston members is increased from the lower limit of the predetermined range by a further predetermined value while the pressure of the pressurized fluid is increased.

The first snap disc means is transformed from the first configuration to the second configuration when the pressure of the pressurized fluid is increased from the lower limit of the predetermined range by a further predetermined value.

When the pressure of the pressurized fluid is decreased after said first snap disc means was once transformed to the second configuration, the first snap disc means is transformed from the second configuration to the first configuration when the decreasing pressure of the pressurized fluid has reached the lower limit of the predetermined range.

The second snap disc means is in the first configuration until the pressure of the pressurized fluid transmitted through the diaphragm and the first piston transmitted reaches the upper limit of the predetermined range while the pressure of the pressurized fluid is increased, and is transformed form the first configuration to the second configuration when the pressure of the pressurized fluid has reached the upper limit of the predetermined range.

When the pressure of the pressurized fluid is decreased after the second snap disc means is once transformed to the second configuration, the second snap disc means is transformed from the second configuration to the first configuration when the pressure of the pressurized fluid is decreased from the upper limit of the predetermined range by a further predetermined valve.

The third snap disc means is in the first configuration until the pressure of the pressurized fluid transmitted through the diaphragm reaches a predetermined value in the predetermined range while the pressure of the pressurized fluid is increased, and is transformed from the first configuration to the second configuration when the increasing pressure of the pressurized fluid has reached the predetermined value.

When the pressure of the pressurized fluid is decreased after the third snap disc means is once transformed to the second configuration, the third snap disc means is transformed from the second configuration to the first configuration when the pressure of the pressurized fluid is decreased from the predetermined value by a predetermined value.

The first switch means has a pair of resilient switch segments which are arranged further inwardly from the first snap disc means in the moving direction of the first and second piston members in the switch mechanism storage chamber, are formed of an electrically conductive material, and are separated from each other in the moving direction.

The pair of resilient switch segments of the first switch means are separated from each other or are in contact with each other to be in one of the OFF and ON states until the pressure of the pressurized fluid is further increased from the lower limit of the predetermined range by the predetermined value while the pressure is increased.

When the pressure of the pressurized fluid is increased from the lower limit of the predetermined range by the predetermined value and the first snap disc means is transformed from the first configuration to the second configuration, one of the pair of resilient switch segments is pressed by one of the transformed first snap disc means and the second piston member which is moved inwardly in the switch mechanism storage chamber upon transformation of the first snap disc means, so as to be resiliently transformed, and one resilient switch segment which is resiliently transformed is in contact with or separated from the other resilient switch segment to set the other one of the ON and OFF states.

When the pressure of the pressurized fluid is further increased over the upper limit of the predetermined range and the second snap disc means is transformed from the first configuration to the second configuration, the other resilient switch segment is pressed by the first actuating rod which is moved inwardly in the switch mechanism storage chamber upon transformation of the second snap disc means, so as to be resiliently transformed, and the other resilient switch segment which is resiliently transformed is again separated from or in contact with the one resilient switch segment which has been already resiliently transformed to set the one of the OFF and ON states.

When the pressure of the compressed fluid is further decreased from the upper limit of the predetermined range by the predetermined value while the pressure of the pressurized fluid is decreased after the second snap disc means is deformed to the second configuration, the second snap disc means is transformed from the second configuration to the first configuration, so that the first actuating rod is allowed to be moved toward the diaphragm in the switch mechanism storage chamber, pressing of the other resilient switch segment by the first actuating rod is released, and the other resilient switch segment is in contact with or separated from the one resilient switch segment again to recover the other one of the ON and OFF states.

When the pressure of the pressurized fluid reaches the lower limit of the predetermined range while the pressure of the pressurized fluid is decreased after at least the first snap disc means is transformed to the second configuration, the first snap disc means is transformed from the second configuration to the first configuration, so that the second piston member is allowed to be moved toward the diaphragm in the switch mechanism storage chamber, pressing of the one resilient switch segment by one of the first snap disc means and the second piston member is released, and as a result, the one resilient switch segment is again separated or in contact with the other resilient switch segment to set the one of the OFF and ON states.

The second switch means has at least one resilient switch segment which is arranged further inwardly from the first snap disc means in the moving direction of the first and second piston members in the switch mechanism storage chamber, and is formed of an electrically conductive material.

The at least one resilient switch segment of the second switch means is set in one of the ON and OFF states when the third snap disc means is in the first configuration until the pressure of the pressurized fluid reaches the predetermined value in the predetermined range while the pressure is increased.

When the increasing pressure of the pressurized fluid has reached the predetermined value and the third snap disc means is transformed from the first configuration to the second configuration, the at least one resilient switch segment is pressed by the second actuating rod which is moved inwardly in the switch mechanism storage chamber upon transformation of the third snap disc means, so as to be resiliently transformed, and the at least one switch segment which is resiliently transformed is set in the other one of the OFF and ON states.

When the pressure of the pressurized fluid is further decreased from the predetermined value by a further predetermined value while the pressure is decreased after the third snap disc means is once transformed to the second configuration, and the third snap disc means is transformed from the second configuration to the first configuration, the second actuating rod is allowed to be moved toward the diaphragm in the switch mechanism storage chamber upon transformation of the third snap disc means and pressing of the at least one resilient switch segment by the second actuating rod is released, so that the at least one resilient switch segment is recovered to the one of the ON and OFF states.

The first and second switch means are electrically connected to the other end of each of two terminal means whose one end projects outside the housing.

In each of the first snap disc means for turning on or off the first switch means at the lower limit of the predetermined range of the pressure of the pressurized fluid, the second snap disc means for turning off or on the first switch means at the upper limit of the predetermined range of the pressure of the pressurized fluid, and the third snap disc means for turning on or off the second switch means at the predetermined value in the predetermined range of the pressure of the pressurized fluid, there is a predetermined width between a pressure value, obtained when the pressure of the pressurized fluid is increased and each snap disc means is transformed from the first configuration to the second configuration, and a pressure value, obtained when the pressure of the pressurized fluid is decreased and each snap disc means is transformed from the second configuration to the first configuration. This width can surely prevent the first and second switch means from the above-mentioned erroneous operation due to chattering.

In the triple action pressure switch apparatus according to the present invention with the above structure, it is preferable that the housing has a first housing portion having a pressurized fluid introduction path and a pressure actuating chamber, and a second housing portion which has a switch mechanism storage chamber and is detachably coupled to the first housing portion. The peripheral portion of the diaphragm is preferably fixed in a sealed state at the coupling portion between the first and second housing portions.

This structure allows easy assembly of the triple action pressure switch apparatus according to the present invention.

In the triple action pressure switch apparatus according to the present invention, the diaphragm is preferably formed of a synthetic resin film.

This diaphragm can be easily manufactured and is inexpensive.

In the triple action pressure switch apparatus according to the present invention, each of the second and third snap disc means is preferably constituted by a plurality of snap discs which are concentrically stacked on each other.

Since the second and third snap disc means which receive a relatively high pressure load are arranged as described above, the durability of the second and third snap disc means can be improved, and setting of a pressure for causing these snap disc means to exhibit a snap action can be facilitated.

In the triple action pressure switch apparatus according to the present invention, the pair of resilient switch segments of the first switch means are preferably arranged to be separated from each other in a moving direction of the first and second piston members. The at least one resilient switch segment of the second switch means is preferably arranged to be separated from the pair of resilient switch segments of the first switch means at location farther from the first snap disc means than from the first switch means in the moving direction. The first actuating rod preferably has an annular shape, and is inserted in the central portion of the first snap disc means to be movable in the moving direction. The second actuating rod preferably has a rod-like shape, and is inserted in the central portion of the first piston member and in a central hole of the annular first actuating rod to be movable in the moving direction. It is preferable that one of the pair of resilient switch segments of the first switch means located near to the first snap disc means has a through hole through which the first actuating rod is inserted, and the other switch segment thereof located near to the second switch means has a through hole through which only the second actuating rod is inserted.

This structure makes the arrangements of the first and second switch means compact.

In the triple action pressure switch apparatus according to the present invention, the second piston member preferably has a low-pressure actuating projection which is formed into an annular shape along the peripheral surface of the first actuating rod on the side surface of the second piston member located near to the first snap disc means, is inserted in the first snap disc means, and projects toward the pair of resilient switch segments of the first switch means. When the pressure of the pressurized fluid is increased from the lower limit of the predetermined range by the predetermined value while the pressure of the pressurized fluid is increased, and when the first snap disc means is transformed from the first configuration to the second configuration so that the second piston member is moved inwardly in the switch mechanism storage chamber, the other one of the ON and OFF states is preferably established wherein the low-pressure actuating projecting portion of the second piston member presses one of the pair of resilient switch segments of the first switch means and contacts or is separated from the other resilient switch segment.

The second piston member with the above structure guarantees the operation of the triple action pressure switch apparatus according to the present invention at the lower limit of the predetermined pressure range, and is compact.

The triple action pressure switch apparatus according to the present invention preferably has a piston member moving distance restricting means in the switch mechanism storage chamber. The piston member moving distance restricting means abuts against the second piston member which is moved inwardly in the switch mechanism storage chamber upon transformation of the first snap disc means from the first configuration to the second configuration so as to restrict the moving distance of the second piston member.

The piston member moving distance restricting means can reliably prevent destruction of the first snap disc means due to excess transformation when the pressure of the pressurized fluid is increased over the lower limit of the predetermined range, and destruction of the first switch means which is operated in correspondence with the transformation of the first snap disc means.

The piston member moving distance restricting means is preferably constituted by a stepped portion formed on the inner surface of the switch mechanism storage chamber in the inner space of the housing.

The stepped portion described above can be very easily formed, and does not increase the number of components of the triple action pressure switch apparatus and the outer dimensions thereof.

In the triple action pressure switch apparatus according to the present invention, the housing preferably has a recess formed on the outer peripheral surface, and externally projecting ends of the two pairs of terminals are preferably fitted in the recess.

The recess can reliably prevent damage of the two pairs of terminals due to an external force.

In the triple action pressure switch apparatus according to the present invention, the recess, the switch mechanism storage chamber, and the pressure actuating chamber of the housing are preferably aligned in a line, and the path and the externally projecting ends of the two pairs of terminals preferably extend in the direction parallel to the line.

This arrangement can make the overall triple action pressure switch apparatus compact.

The above-mentioned object of the present invention can also be achieved by a triple action pressure switch having the same construction as the triple action pressure switch described above, excepting that the functions of first and second snap disc means are replaced.

DETAILED DESCRIPTION OF THE PREFERRED EMBODIMENTS

An embodiment and first to third modifications of the present invention will be described hereinafter with reference to the accompanying drawings. In this description, value of pressure is a gauge pressure.

Figure 1:
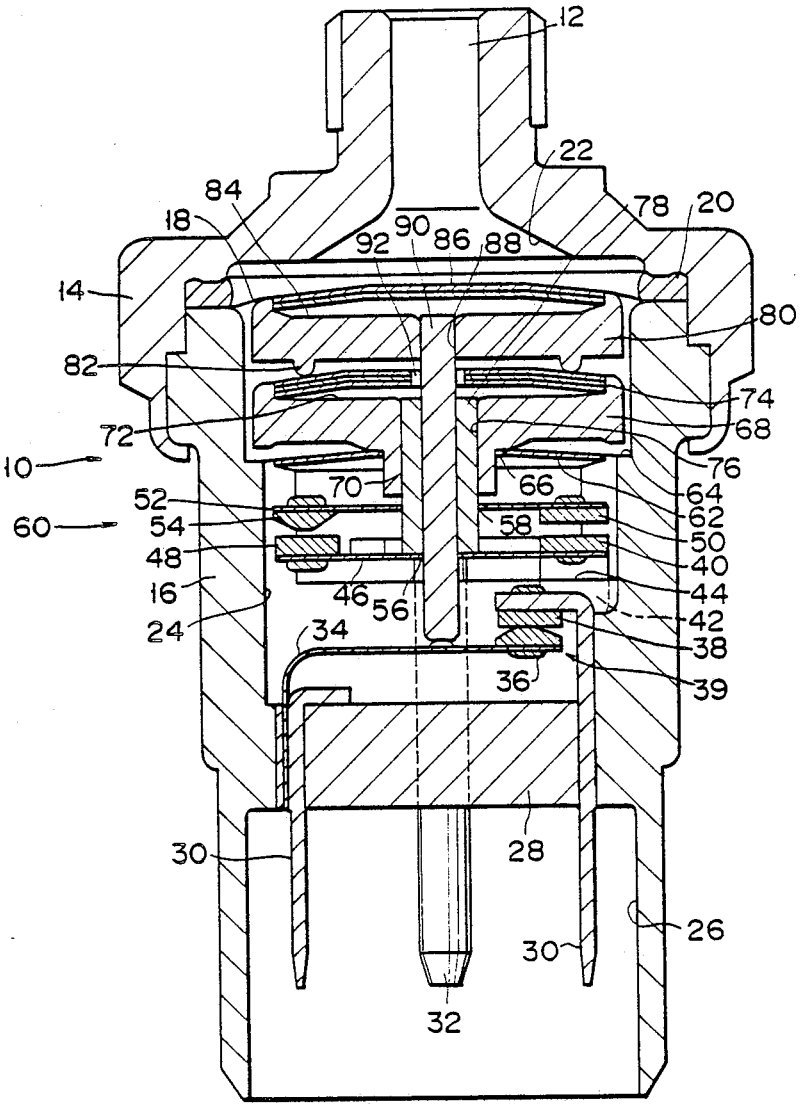
FIG. 1 is a schematic longitudinal sectional view of an overall triple action pressure switch apparatus according to an embodiment of the present invention, wherein a pressure of a pressurized fluid introduced into a pressure actuating chamber in an inner space of a housing does not increase to a lower limit of a predetermined range.

In FIG. 1, reference numeral 10 denotes a housing having an inner space. Housing 10 is constituted by first housing portion 14 formed of a metal and having a pressurized fluid introduction path 12 for guiding a pressurized fluid into the inner space, and second housing portion 16 which is coupled to first housing portion 14 by caulking an open end of the inner space of first housing 14. Second housing portion 16 need not be air-tight. However, it is preferable that no water enters second housing portion 16. In this embodiment, second housing portion 16 is formed of glass-fiber reinforced polybutylene telephthalate.

An opening of the inner space of second housing portion 16 at a coupling end face thereof is covered by diaphragm 18 made of polyimide resin film. The peripheral portion of diaphragm 18 is urged against the inner surface of the inner space of first housing portion 14 through annular packing 20. Diaphragm 18 partitions the inner space of housing 10 into pressure actuating chamber 22 communicating with pressurized fluid introduction path 12 in first housing portion 14 and switch mechanism storage chamber 24 which is hermetically sealed from pressure actuating chamber 22 by diaphragm 18 in second housing portion 16.

Recess 26 is formed on the end face of second housing portion 16 located far away from first housing portion 14. Pressurized fluid introduction path 12 and pressure actuating chamber 22 of first housing portion 14, and recess 26 and switch mechanism storage chamber 24 of second housing portion 16 are linearly arrayed in the axial direction of housing 10.

Two pairs of terminal members 30 and 32 are inserted in partition wall 28 between recess 26 and switch mechanism storage chamber 24 at both ends of each of two radially extending lines which are substantially perpendicular to each other, so that both ends of each of members 30 and 32 project into recess 26 and switch mechanism storage chamber 24.

The proximal end portions of one pair of terminal members 30 in switch mechanism storage chamber 24 are formed to have a lower height from partition wall 28 than those of the other pair of terminal members 32 in storage chamber 24. In FIG. 1, only one of the other pair of terminal members 32 is illustrated.

As shown in FIG. 1, the proximal end portion of one of one pair of terminal members 30 is bent along the inner surface of partition wall 28. The proximal end portion of the other terminal member 30 projects further inwardly from the inner surface of partition wall 28 and then, the inwardly extending end is bent to face the inner surface of partition wall 28. One end of first resilient switch segment 34 formed of a material having electrical conductivity and resiliency is fixed to the proximal end portion of one terminal member 30. The other end of first resilient switch segment 34 extends further inwardly from the inner surface of partition wall 28 and then is bent to extend along the inner surface of partition wall 28 to a position located under the inwardly extending end of the other terminal member 30. Contact 36 is fixed to the other end of first resilient switch segment 34, and contact 38 is fixed to the inwardly extending end of the other terminal member 30 so that contact 38 contacts contact 36 of the other end of first resilient switch segment 34 from the above. First resilient switch segment 34 and the inwardly extending end of the other terminal member 30 constitute second switch means 39 for performing a predetermined operation to be described later.

In switch mechanism storage chamber 24, one of the proximal end portions of the other pair of terminal members 32 extends above the inner surface of partition wall 28 in a direction parallel to a straight line connecting the proximal end portions of one pair of terminal members 30 at a position above the proximal end portions of one pair of terminal members 30. Extending end 40 of the proximal end portion reaches a position near the inner peripheral surface of switch mechanism storage chamber 24. Support segment 42 bent toward partition wall 28 is formed on extending end 40. Support segment 42 is inserted and supported in a support recess on stepped support portion 44 formed on the inner peripheral surface of switch mechanism storage chamber 24. One end of second resilient switch segment 46 is fixed to extending end 40 and the other end of second resilient switch segment 46 extends to be parallel to first resilient switch segment 34 above first resilient switch segment 34. Second resilient switch segment 46 is formed of a material having electrical conductivity and resiliency. Contact 48 is fixed to the other end of second resilient switch segment 46 to face in an opposite direction to the bottom surface (i.e., the inner surface of partition wall 28) of switch mechanism storage chamber 24.

In switch mechanism storage chamber 24, the other proximal end portion of the other pair of terminal members 32 extends above the inner surface of partition wall 28 in a direction parallel to a straight line connecting the proximal end portions of one pair of terminal members 30 at a position above the proximal end portions of one pair of terminal members 30. A support segment (not shown) bent toward partition wall 28 is formed on extending end 50 of the proximal end portion of the other terminal member 32. This support segment is also inserted and supported in a support recess formed on stepped support portion 44 formed on the inner peripheral surface of switch mechanism storage chamber 24. One end of third resilient switch segment 52 is fixed to extending end 50, and the other end of third resilient switch segment 52 extends along second resilient switch segment 46 above second resilient switch segment 46. Third resilient switch segment 52 is also formed of a material having electrical conductivity and resiliency. Contact 54 is fixed to the other end of third resilient switch segment 52 to face contact 48 fixed at the other end of second resilient switch segment 46.

Elongated through hole 56 is formed in the middle portion of second resilient switch segment 46 with its major axis extending in the longitudinal direction of segment 46. Elongated through hole 58 is formed in the middle portion of third resilient switch segment 52 with its major axis extending in the longitudinal direction of segment 52. Through hole 56 is coaxial with through hole 58, but the diameter of through hole 58 of third resilient switch segment 52 is larger than that of through hole 56 of second resilient switch segment 46.

Second and third resilient switch segments 46 and 52 having the arrangement and structure as described above cooperate to constitute first switch means 60 for performing a predetermined operation (to be described later).

In switch mechanism storage chamber 24 of second housing portion 16, first snap disc means 62 is arrange above third resilient switch segment 52 (nearer to diaphragm 18 than to third resilient switch segment 52). In this embodiment, first snap disc means 62 is constituted by a single snap disc. The periphery of first snap disc means 62 is placed in a small notch of an inner peripheral edge of substantially annular stepped portion 64 formed on the inner peripheral surface of switch mechanism storage chamber 24 above third resilient switch segment 52. In FIG. 1, the central portion of first snap disc means 62 projects upward, and through hole 66 is formed in its central portion.

In switch mechanism storage chamber 24 of second housing portion 16, second piston member 68 is arranged above first snap disc means 62. Second piston member 68 is slidable in the axial direction of second housing portion 16 in a large-diameter region of the inner peripheral surface of switch mechanism storage chamber 24, and is supported by the upper projecting central portion of first snap disc means 62. The peripheral portion of the lower surface of second piston member 68 is separated upward from stepped portion 64 by a predetermined distance. Low-pressure actuating projection 70 is formed at the central portion of the lower surface. Projection 70 is inserted in through hole 66 formed at the central portion of first snap disc means 62, and extends to approach the upper surface of third resilient switch segment 52.

Shallow circular receiving recess 72 having a flat bottom surface is formed in the upper surface of second piston member 68. Second snap disc means 74 having substantially the same diameter as that of receiving recess 72 is arranged in receiving recess 72. In this embodiment, second snap disc means 74 is constituted by three snap discs. The three snap discs are stacked with a lubricant containing solid molybdenum disulfide being pasted therebetween to allow smooth movement therebetween. In FIG. 1, the center portion of second snap disc means 74 projects upward.

Guide hole 76 is formed at the central portion of second piston member 68 to extend in the axial direction of second piston member 68. Upper end of guide hole 76 is open at the central portion of receiving recess 72 on the upper surface of the second piston member 68 and the lower end thereof is open at the end face of low-pressure actuating projection 70 on the lower surface of second piston member 68.

Tubular first actuating rod 78 is inserted in guide hole 76. First actuating rod 78 is slidable in guide hole 76 in its axial direction. The lower end of first actuating rod 78 is inserted in through hole 58 formed in the central portion of third resilient switch segment 52, and abuts against the upper surface of second resilient switch 46 at the periphery of through hole 56. First actuating rod 78 is formed of a light material so as not to substantially flex second resilient switch segment 46 and so as to reliably transmit deformation due to a snap effect (to be described later) of second snap disc means 74 to second elastic switch segment 46 without causing self deformation.

In switch mechanism storage chamber 24 of second housing portion 16, first piston member 80 is arranged above second snap disc means 74. First piston member 80 is slidable in the axial direction of second housing portion 16 in the large-diameter region of the inner peripheral surface of switch mechanism storage chamber 24, and is supported on the upper projecting central portion of second snap disc means 74 by annular support projection 82 which is formed on the lower surface of piston member 80 to be concentrical with the central axis of second housing portion 16.

The upper surface of first piston member 80 abuts against diaphragm 18. Shallow circular receiving recess 84 having a flat bottom surface is formed on the upper surface. Third snap disc means 86 having substantially the same diameter as that of receiving recess 84 is arranged in receiving recess 84. In this embodiment, third snap disc means 86 is constituted by two snap discs. The two snap discs are stacked with a lubricant containing solid molybdenum disulfide being pasted therebetween to allow smooth movement therebetween. In FIG. 1, the central portion of third snap disc means 86 projects upward.

Guide hole 88 extending in the axial direction of first piston member 80 is formed at the central portion of first piston member 80. One end of guide hole 88 is open at the central portion of receiving recess 84 on the upper surface of first piston member 80, and the other end of guide hole 88 is open at the central portion of the lower surface of first piston member 80.

Second actuating rod 90 is slidable in guide hole 88 in its axial direction. The lower end portion of second actuating rod 90 is inserted in through hole 92 at the central portion of second snap disc means 74, is then inserted in a central hole of first actuating rod 78, is finally inserted in through hole 56 formed in the central portion of second resilient switch segment 46, and abuts against the upper surface of first resilient switch segment 34. Second actuating rod 90 is formed of a material so as not to substantially flex first resilient switch segment 34 and so as to reliably transmit deformation due to a snap effect (to be described later) of third snap disc means 86 to first resilient switch segment 34 without causing self deformation.

In the triple action pressure switch apparatus according to the embodiment of the present invention with the above arrangement, pressurized fluid introduction path 12 is coupled to a pressurized fluid path such as a coolant path in a refrigeration system (not shown) of an automative air conditioner, and the externally projecting ends of the two pairs of terminal members 30 and 32 are electrically coupled to a socket member (not shown) inserted in recess 26 of housing 10. The pair of terminal members 32 for first switch means 60 are connected to, e.g., an electrical circuit for a compressor in the refrigeration system. The pair of terminal members 30 for second switch means 39 are coupled to, e.g., an electrical circuit of a fan motor for a condenser of the refrigeration system.

When a pressure of a coolant in the coolant path increases and reaches 250 kPa, first snap disc means 62 which receives the pressure of the coolant introduced into pressure actuating chamber 22 through diaphragm 18, third snap disc means 86, first piston member 80, second snap disc means 74, and second piston member 68, makes snap-transformation from a first configuration wherein its central portion projects upward as shown in FIG. 1 to a second configuration wherein its central portion projects downward. Such deformation of first snap disc means 62 causes downward sliding of second piston member 68 which receives the pressure of the coolant introduced into pressure actuating chamber 22 through diaphragm 18, third snap disc means 86, first piston member 80, and second snap disc means 74.

Low-pressure actuating projection 70 of second piston member 68 slid downward presses third resilient switch segment 52 downward. Thus, contact 54 of third resilient switch segment 52 is brought into contact with contact 48 of second resilient switch segment 46. As a result, the electrical circuit of the compressor (not shown) is turned on.

The downward sliding of second piston member 68 is stopped since the peripheral portion of the lower surface thereof abuts against stepped portion 64 of second housing portion 16. More specifically, stepped portion 64 serves as a piston member moving distance restricting means for restricting the downward moving distance of second piston member 68.

Since second piston member 68 abuts against stepped portion 64, first snap disc means 62 can be prevented from being excessively deformed due to an increase in pressure of the coolant to 250 kPa or more. As a result, even if the pressure of the coolant is increased to 250 kPa or more, first snap disc means 62 cannot be plastically deformed.

In this embodiment, when the pressure of the coolant is decreased to 210 kPa or less, first snap disc means 62 can be transformed from the second configuration wherein its central portion projects downward to the first configuration shown in FIG. 1 by the function of self resiliency and the resilient force accumulated on third resilient switch segment 52. Such transformation of first snap disc means 62 causes contact 54 of third resilient switch segment 52 to separate from contact 48 of second resilient switch segment 48, as shown in FIG. 1. As a result, the electrical circuit of the compressor (not shown) is turned off.

In this embodiment, until the pressure of the coolant is further increased and reaches 1.47 MPa, third snap disc means 86 is not transformed from a first configuration wherein its central portion projects upward as shown in FIG. 1 to a second configuration wherein its central portion projects downward. When first snap disc means 62 is in the second configuration wherein its central portion projects downward while third snap disc means 86 is in the first configuration wherein its central portion projects upward, i.e., until the pressure of the coolant is increased from 250 kPa to 1.47 MPa, the upper end of second actuating rod 90 projects into receiving recess 88 in the upper surface of first piston member 80, but a gap is formed between the lower surface of third snap disc means 86 whose central portion projects upward and the upper end of second actuating rod 90. Therefore, first resilient switch segment 34 will not be pressed by second actuating rod 90 to be curved downward such that contact 36 is separated from contact 38 fixed to the inwardly extending end of the proximal end portion of corresponding terminal member 30. As a result, the electrical circuit of the fan motor for the condenser (not shown) is kept ON. In this embodiment, when the electrical circuit for the fan motor of the condenser (not shown) is kept on, the fan motor (not shown) is not rotated.

When the increasing pressure of the coolant has reached 1.47 MPa, third snap disc means 86 makes snap-transformation from the first configuration wherein its central portion projects upward as shown in FIG. 1 to the second configuration wherein its central portion projects downward. The lower surface of the central portion of third snap disc means 86 which has been transformed to the second configuration presses second actuating rod 90 downward, and the second actuating rod 90 causes first resilient switch segment 34 to be curved downward so that contact 36 of first resilient switch segment 34 is separated from contact 38 fixed to the inwardly extending end of the proximal end portion of corresponding terminal member 30. By this motion, the electrical circuit for the fan motor of the condenser (not shown) is turned off. As a result, in this embodiment, the fan motor (not shown) is rotated to cool the condenser.

In this embodiment, when the pressure of the coolant is decreased to 1.08 MPa or less, third snap disc means 86 can be transformed from the second configuration wherein its central portion projects downward to the first configuration wherein its central portion projects upward, as shown in FIG. 1, by the function of the self resiliency and the resilient force accumulated on first resilient switch segment 34. Such transformation of third snap disc means 86 causes contact 36 of first resilient switch segment 34 to abut against contact 38 of the inwardly extending end of the proximal end portion of corresponding terminal member 30, as shown in FIG. 1. In this manner, the electrical circuit of the fan motor for the condenser (not shown) is turned on. As a result, in this embodiment, rotation of the fan motor for cooling the condenser (not shown) is stopped.

In this embodiment, until the pressure of the coolant is further increased and reaches 2.65 MPa, second snap disc means 74 does not make transformation from the first configuration wherein its central portion projects upward as shown in FIG. 1 to the second configuration wherein its central portion projects downward. When the first snap disc means 62 is in the second configuration wherein its central portion projects downward while second snap disc means 74 is in the first configuration wherein its central portion projects upward, the upper end of first actuating rod 78 projects into receiving recess 72 in the upper surface of second piston member 68, but a gap is formed between the lower surface of second snap disc means 74 whose central portion projects upward, and the upper end of first actuating rod 78. Therefore, second resilient switch segment 46 will not be depressed by first actuating rod 78 to be curved downward such that contact 48 is separated from contact 54 of third resilient switch segment 52 which has been resiliently deformed to be curved downward, as described above. For this reason, the electrical circuit for the compressor (not shown) is kept ON.

When the increasing pressure of the coolant has reached 2.65 MPa, second snap disc means 74 makes snap-transformation from the first configuration wherein its central portion projects upward as shown in FIG. 1 to the second configuration wherein its central portion projects downward. The lower surface of the central portion of second snap disc means 74 which has been deformed to the second configuration presses first actuating rod 78 downward, and first actuating rod 78 causes second resilient switch segment 46 to be curved downward so that contact 48 is separated from contact 54 of third resilient switch segment 46 which has been curved downward as described above. As a result, the electrical circuit for the compressor (not shown) is turned off.

In this embodiment, when the pressure of the coolant decreases and has reached 2.15 MPa, second snap disc means 74 can be transformed from the second configuration wherein its central portion projects downward to the first configuration wherein its central portion projects upward, as shown in FIG. 1, by the function of the self resiliency and the resilient force accumulated on second resilient switch segment 46. Such transformation of second snap disc means 74 causes contact 48 of second resilient switch 46 to be in contact with contact 54 of third resilient switch segment 52 which has been curved downward, as described above. As a result, the electrical circuit for the compressor (not shown) is turned on.

Figure 2:
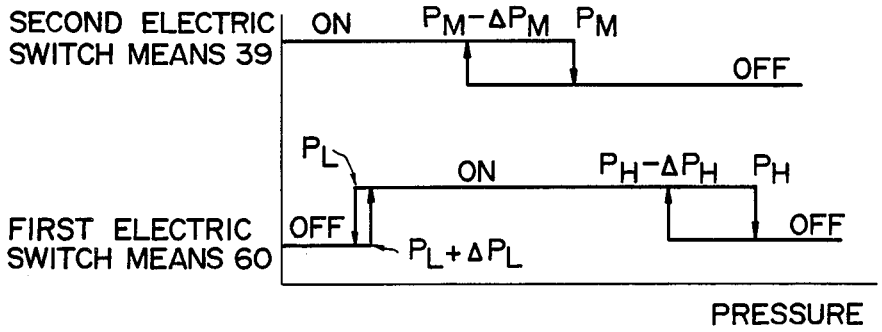
FIG. 2 is a graph schematically showing operation characteristics of first and second switch means of the apparatus shown in FIG. 1 with reference to the pressure of the pressurized fluid.

FIG. 2 schematically shows the operation characteristics of first and second switch means 60 and 39 in the triple action pressure switch apparatus of the above-mentioned embodiment in correspondence with a change in pressure of the coolant.

In FIG. 2, point PL indicates 2.10 kPa; PL+ ΔPL, 250 kPa; PM-ΔPM, 1.08 MPa; PM, 1.47 MPa; PH-ΔPH, 2.15 MPa; and PH, 2.65 MPa.

PL+ΔPL indicates a value when first electric switch means 60 is turned on for the first time while the pressure of the coolant is increased. PL and PH respectively indicate upper- and lower-limit values when the first electric switch means 60 is turned off after it is temporarily turned on. PH-ΔPH indicates a value when first electric switch means 60 is turned on again after the pressure of the coolant is increased to PH or more as the upper-limit value and first electric switch means 60 is temporarily turned off.

More specifically, once the increasing pressure of the coolant has reached PL+ΔPL and first electric switch means 60 is turned on, switch means 60 is turned off only when the pressure of the coolant is decreased or increased to fall outside a predetermined range whose upper and lower limits are determined by PH and PL, respectively.

Figure 3:
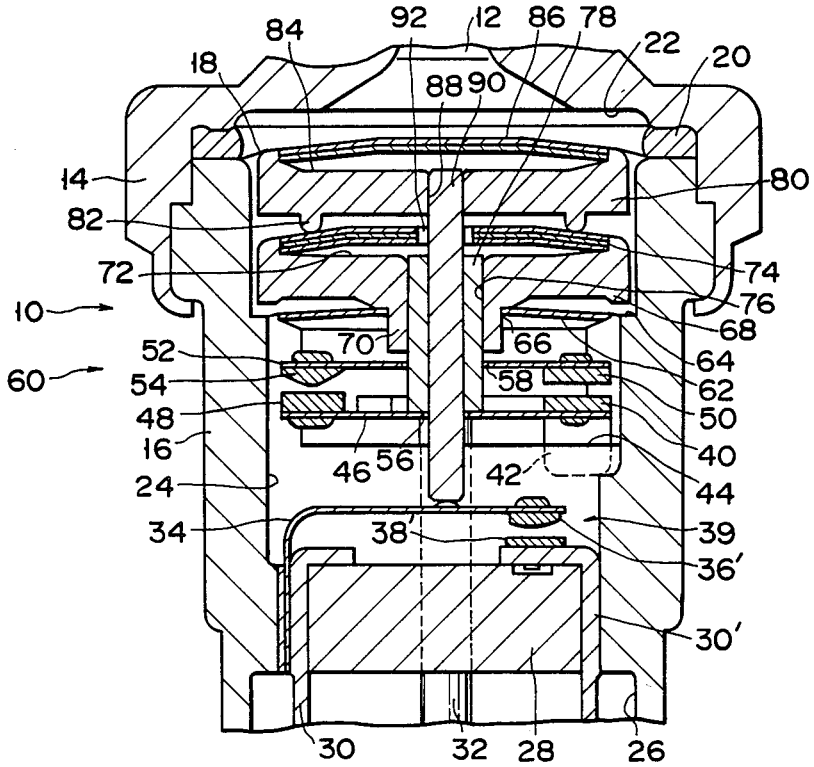
FIG. 3 is a schematic longitudinal sectional view of the main portion of a first modification of the apparatus shown in FIG. 1, wherein the pressure of the pressurized fluid introduced into the pressure actuating chamber in the inner space of the housing does not increase to the lower limit of the predetermined range.

FIG. 3 is a longitudinal sectional view of the main portion of a first modification of the triple action pressure switch apparatus according to the embodiment shown in FIG. 1. The same reference numerals in this modification denote the same parts as in the above embodiment, and a detailed description thereof will be omitted.

In this modification, unlike in the above embodiment, contact 36' of the extending end of first resilient switch segment 34 faces partition wall 28, inwardly extending end of the proximal end portion of terminal member 30' supporting contact 38' is bent to overlap the inner surface of partition wall 28, and contact 38' of the inwardly extending end of the proximal end portion of terminal member 30' is separated downward from contact 36' of the extending end of first resilient switch segment 34.

Figure 4:
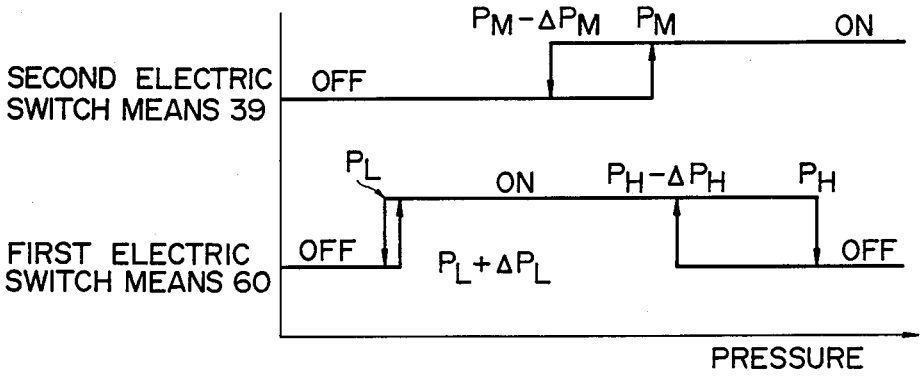
FIG. 4 is a graph schematically showing operation characteristic of first and second switch means of the apparatus shown in FIG. 3 with reference to the pressure of the pressurized fluid.

FIG. 4 schematically shows the operation characteristics of first and second switch means 60 and 39 in the first modification as described above in correspondence with a change in pressure of the coolant.

In the first modification, the operation of the second switch means 39 in correspondence with a change in pressure of the coolant is reversed to that in the above embodiment. That is, second switch means 39 is kept OFF until the increasing pressure reaches PM. When the pressure has reached PM, second switch means 39 is turned on. Second switch means 39 which has been turned on is turned off again when the pressure decreases from PM and reaches PM-ΔPM. The fan motor for the condenser (not shown), controlled by second switch means 39, is rotated or stopped in response to an ON/OFF state of second switch means 39.

Figure 5:
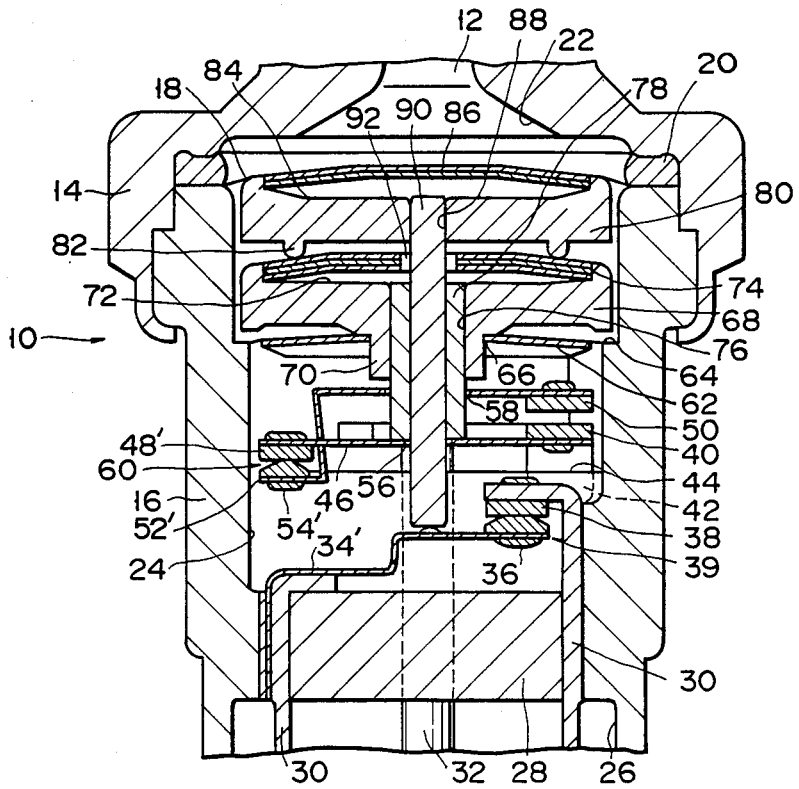
FIG. 5 is a schematic longitudinal sectional view of the main portion of a second modification of the apparatus shown in FIG. 1 wherein the pressure of the pressurized fluid introduced into the pressure actuating chamber in the inner space of the housing does not increase to the lower limit of the predetermined range.

FIG. 5 is a longitudinal sectional view of the main portion of a second modification of the triple action pressure switch apparatus according to the embodiment shown in FIG. 1. The same reference numerals in this modification denote the same parts as in the above embodiment, and a detailed description thereof will be omitted.

In this modification, unlike in the above embodiment, first resilient switch segment 34' for second switch means 39 extends along the inner surface of partition wall 28 with keeping a short distance therebetween between a fixed portion to terminal member 30 and a contact portion with second actuating rod 90, so that first resilient switch segment 34' has a crank shape in a side elevational view. In this modification, the extending end portion of third resilient switch segment 52' is bent to be located below the extending end portion of second resilient switch segment 46. Contact 48' fixed to the extending end portion of second resilient switch segment 46 faces downward, and contact 54' fixed to the bent extending end portion of third resilient switch segment 52' faces upward to be in contact with contact 48' of second resilient switch segment 46.

Figure 6:
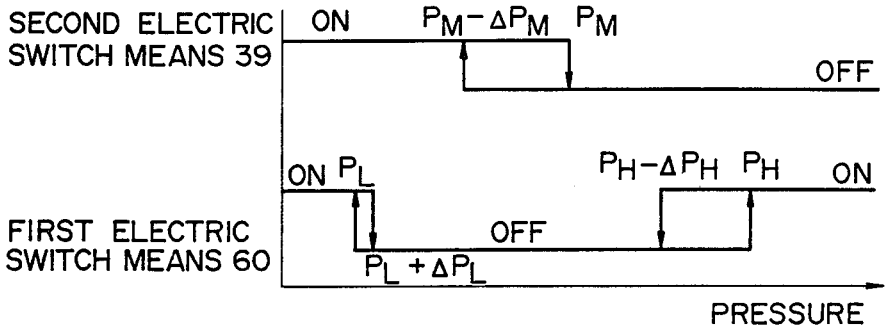
FIG. 6 is a graph schematically showing operation characteristics of first and second switch means of the apparatus shown in FIG. 5 with reference to the pressure of the pressurized fluid.

FIG. 6 schematically shows the operation characteristics of first and second switch means 60 and 39 in the second modification as described above in correspondence with a change in pressure of the coolant.

In the second modification, the operation of the first switch means 60 in correspondence with a change in pressure of the coolant is reversed to that in the above embodiment. That is, first switch means 60 is kept ON until the increasing pressure of the coolant has reached PL+ΔPL, and is turned off when the pressure has reached PL+ΔPL. First switch means 60 which has been turned off is turned on again when the pressure is further increased and reaches PH. When the pressure is decreased from PH and reaches PH-ΔPH, first switch means 60 is turned off again. When the pressure is further decreased and reaches PL, first switch means 60 is turned on again.

In the second modification, the compressor (not shown) controlled by first switch means 60 is rotated or stopped in response to an OFF/ON state of first switch means 60.

Figure 7:
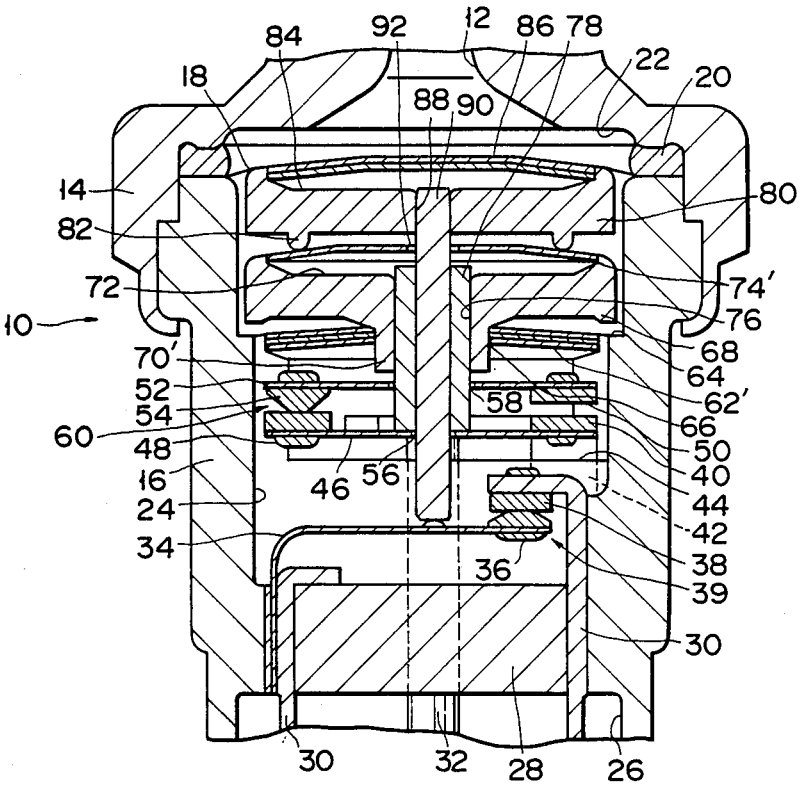
FIG. 7 is a schematic longitudinal sectional view of the main portion of a third modification of the apparatus shown in FIG. 1, wherein the pressure of the pressurized fluid introduced into the pressure actuating chamber in the inner space of the housing does not increase to the lower limit of the predetermined range, and the operation characteristics of the first and second switch means of the third modification are the same as those of the second modification.

FIG. 7 is a longitudinal sectional view of the main portion of a third modification of the triple action pressure switch apparatus according to the embodiment shown in FIG. 1. The same reference numerals in this modification denote the same parts as in the above embodiment, and a detailed description thereof will be omitted.

In this modification, unlike in the above embodiment, the functions of first and second snap disc means 62' and 74' are replaced. In this modification, first snap disc means 62' is constituted by three snap discs which are stacked on each other, and second snap disc means 74' is constituted by a single snap disc.

In the third modification, the operations of first and second switch means 60 and 39 in correspondence with a change in pressure of the coolant are the same as those in the second modification shown in FIG. 6. Projection 70' formed in the central portion of the lower surface of second piston member 68 functions as a high-pressure actuating projection.

The above embodiment has been described to explain the present invention, and does not limit the scope of the present invention. The present invention incorporates all the changes and modifications within the technical scope of the invention.

For example, first and second switch means 60 and 39 may be connected to an electrical circuit for an alarm means such as an alarm lamp or buzzer.

What is claimed is:

1. A triple action pressure switch apparatus including first switch means which is set in one of ON and OFF states when a pressure of a pressurized fluid is set within a predetermined range, and is set in the other of the ON and OFF states when the pressure of the pressurized fluid is decreased below a lower limit of the predetermined range and is increased over an upper limit of the predetermined range, and second switch means which is set in one of the ON and OFF states when the pressure of the pressurized fluid is set to be larger than a predetermined value within the predetermined range, and is set in the other of the ON and OFF states when the pressure of the pressurized fluid is decreased below the predetermined value, comprising:

a housing having an inner space and a path for introducing the pressurized fluid into said inner space;

a diaphragm which is provided in said inner space so that said inner space of said housing is partitioned into a pressure actuating chamber communicating with said pressurized fluid introduction path and a switch mechanism storage chamber blocked from said pressurized fluid introduction path in a sealed state;

a first piston member which is arranged adjacent to said diaphragm in said switch mechanism storage chamber, and is moved together with a central portion of said diaphragm in a moving direction of said central portion when said central portion is moved upon movement of said diaphragm;

a second piston member which is arranged adjacent to said first piston member at a side farther from said diaphragm in said switch mechanism storage chamber, and is moved together with said first piston member in a moving direction of said first piston member when said first piston member is moved upon deformation of said diaphragm;

first snap disc means which is arranged adjacent to a side surface of said second piston member farther from said first piston member in said switch mechanism storage chamber, a peripheral portion of which is supported by a peripheral surface of said switch mechanism storage chamber so as not to be moved away from said diaphragm in the moving direction of said second piston member, and which is transformable with a snap action between a first configuration wherein its central portion projects toward said diaphragm to cause said second piston member to move close to said diaphragm and a second configuration wherein its central portion projects in a direction away from said diaphragm to cause said second piston member to be moved inwardly in the moving direction in said switch mechanism storage chamber, said first snap disc means being in the first configuration until the pressure of the pressurized fluid transmitted through said diaphragm and said first and second piston members is increased from the lower limit of the predetermined range by a further predetermined value while the pressure of the pressurized fluid is increased, said first snap disc means being transformed from the first configuration to the second configuration when the pressure of the pressurized fluid is increased from the lower limit of the predetermined range by a further predetermined value, and when the pressure of the pressurized fluid is decreased after said first snap disc means was once transformed to the second configuration, said first snap disc means being transformed from the second configuration to the first configuration when the decreasing pressure of the pressurized fluid has reached the lower limit of the predetermined range;

second snap disc means which is interposed between said second and first piston members, and is transformable with a snap action between a first configuration wherein its central portion projects toward said first piston member and a second configuration wherein its central portion projects in a direction away from said first piston member, said second snap disc means being in the first configuration until the pressure of the pressurized fluid transmitted through said diaphragm and said first piston member reaches the upper limit of the predetermined range while the pressure of the pressurized fluid is increased, said second snap disk being transformed from the first configuration to the second configuration when the pressure of the pressurized fluid has reached the upper limit of the predetermined range, and when the pressure of the pressurized fluid is decreased after said second snap disc means is once transformed to the second configuration, said second snap disc means being transformed from the second configuration to the first configuration when the pressure of the pressurized fluid is decreased from the upper limit of the predetermined range by a further predetermined value;

third snap disc means which is interposed between said first piston member and said diaphragm and is transformable with a snap action between a first configuration wherein its central portion projects toward said diaphragm and a second configuration wherein its central portion projects in a direction away from said diaphragm, said third snap disc means being in the first configuration until the pressure of the pressurized fluid transmitted through said diaphragm reaches a predetermined value in the predetermined range while the pressure of the pressurized fluid is increased, said third snap disc means being transformed from the first configuration to the second configuration when the increasing pressure of the pressurized fluid has reached the predetermined value, and when the pressure of the pressurized fluid is decreased after said third snap disc means is once transformed to the second configuration, said third snap disc means being transformed from the second configuration to the first configuration when the pressure of the pressurized fluid is decreased from the predetermined value by a predetermined value;

a first actuating rod which is inserted in said second piston member and said first snap disc means to be movable in the moving direction of said second piston member and is moved in the moving direction upon transformation of said second snap disc means between the first and second configurations; and a second actuating rod which is inserted in said first piston member, said second snap disc means, said second piston member, and said first snap disc means to be movable in the moving direction of said first piston member, and is moved in the moving direction upon transformation of said third snap disc means between the first and second configurations;

wherein said first switch means has a pair of resilient switch segments which are arranged further inwardly from said first snap disc means in the moving direction of said first and second piston members in said switch mechanism storage chamber, are formed of an electrically conductive material, and are separated from each other in the moving direction, said pair of resilient switch segments of said first switch means are separated from each other or are in contact with each other to be in one of the OFF and ON states until the pressure of the pressurized fluid is further increased from the lower limit of the predetermined range by the predetermined value while the pressure is increased, when the pressure of the pressurized fluid is increased from the lower limit of the predetermined range by the predetermined value and said first snap disc means is transformed from the first configuration to the second configuration, one of said pair of resilient switch segments is pressed by one of the transformed first snap disc means and said second piston member which is moved inwardly in said switch mechanism storage chamber upon transformation of said first snap disc means, so as to be resiliently transformed, and one resilient switch segment which is resiliently transformed is in contact with or separated from the other resilient switch segment to set the other one of the ON and OFF states, when the pressure of the pressurized fluid is further increased over the upper limit of the predetermined range and said second snap disc means is transformed from the first configuration to the second configuration, said other resilient switch segment is pressed by said first actuating rod which is moved inwardly in said switch mechanism storage chamber upon transformation of said second snap disc means, so as to be resiliently transformed, and said other resilient switch segment which is resiliently transformed is again separated from or in contact with said one resilient switch segment which has been already resiliently transformed to set said one of the OFF and ON states, when the pressure of the compressed fluid is further decreased from the upper limit of the predetermined range by the predetermined value while the pressure of the pressurized fluid is decreased after said second snap disc means is transformed to the second configuration, said second snap disc means is transformed from the second configuration to the first configuration, so that said first actuating rod is allowed to be moved toward said diaphragm in said switch mechanism storage chamber, pressing of said other resilient switch segment by said first actuating rod is released, and said other resilient switch segment is in contact with or separated from said one resilient switch segment again to recover said other one of the ON and OFF states, and when the pressure of the pressurized fluid reaches the lower limit of the predetermined range while the pressure of the pressurized fluid is decreased after at least said first snap disc means is transformed to the second configuration, said first snap disc means is transformed from the second configuration to the first configuration, so that said second piston member is allowed to be moved toward said diaphragm in said switch mechanism storage chamber, pressing of said one resilient switch segment by one of said first snap disc means and said second piston member is released, and as a result, said one resilient switch segment is again separated or in contact with said other resilient switch segment to set said one of the OFF and ON states;

wherein said second switch means has at least one resilient switch segment which is arranged further inwardly from said first snap disc means in the moving direction of said first and second piston members in said switch mechanism storage chamber, and is formed of an electrically conductive material, said at least one resilient switch segment of said second switch means is set in one of the ON and OFF states when said third snap disc means is in the first configuration until the pressure of the pressurized fluid reaches the predetermined value in the predetermined range while the pressure is increased, when the increasing pressure of the pressurized fluid has reached the predetermined value and said third snap disc means is transformed from the first configuration to the second configuration, said at least one resilient switch segment is pressed by said second actuating rod which is moved inwardly in said switch mechanism storage chamber upon transformation of said third snap disc means, so as to be resiliently deformed, and said at least one switch segment which is resiliently transformed is set in said other one of the OFF and ON states, when the pressure of the pressurized fluid is further decreased from the predetermined value by a further predetermined value while the pressure is decreased after said third snap disc means is once transformed to the second configuration, and said third snap disc means is transformed from the second configuration to the first configuration, said second actuating rod is allowed to be moved toward said diaphragm in said switch mechanism storage chamber upon transformation of said third snap disc means and pressing of said at least one resilient switch segment by said second actuating rod is released, so that said at least one resilient switch segment is recovered to said one of the ON and OFF states; and wherein said first and second switch means are electrically connected to the other end of each of two terminal means whose one end projects outside said housing.

2. An apparatus according to claim 1, wherein said housing has a first housing portion having said pressurized fluid introduction path and said pressure actuating chamber, and a second housing portion having said switch mechanism storage chamber and detachably coupled to said first housing portion, and the peripheral portion of said diaphragm is fixed to a coupled portion between said first and second housing portions in a sealed state.

3. An apparatus according to claim 1, wherein said diaphragm is formed of a synthetic resin film.

4. An apparatus according to claim 1, wherein each of said second and third snap disc means is constituted by a plurality of snap discs concentrically stacked on each other.

5. An apparatus according to claim 1, wherein said pair of resilient switch segments of said first switch means are arranged to be separated from each other in the moving direction of said first and second piston members, said at least one resilient switch segment of said second switch means is arranged to be separated from said pair of resilient switch segments of said first means at a position farther from said first snap disc means than from said first switch means in the moving direction, said first actuating rod has an annular shape, and is inserted in a central portion of said first snap disc means to be movable in the moving direction, said second actuating rod has a rod-like shape, and is inserted in the central portion of said first piston member and in a central hole of said annular first actuating rod to be movable in the moving direction, and a through hole through which said first actuating rod is inserted is formed in one of said pair of resilient switch segments of said first switch means located near to said first snap disc means, and a through hole through which only said second actuating rod is inserted is formed in the other one of said pair of resilient switch segments located near to said second switch means.

6. An apparatus according to claim 1, wherein said second piston member has a low-pressure actuating projection which has an annular shape along the peripheral surface of said first actuating rod on the side surface of said second piston member located near to said first snap disc means, is inserted in said first snap disc means, and projects toward said pair of resilient switch segments of said first switch means, and when the pressure of the pressurized fluid is increased from the lower limit of the predetermined range by said further predetermined value while the pressure of the pressurized fluid is increased, and said first snap disc means is transformed from the first configuration to the second configuration that said second piston member is moved inwardly in said switch mechanism storage chamber, said low-pressure actuating projection of said second piston member presses said one of said pair of resilient switch segment of said first switch means to be in contact with or separated from said other resilient switch segment, thereby setting said other one of the ON and OFF states.

7. An apparatus according to claim 1, further comprising piston member moving distance restricting means, which abuts against said second piston member moved inwardly in said switch mechanism storage chamber upon transformation of said first snap disc means from the first configuration to the second configuration, so as to restrict a moving distance of said second piston member.

8. An apparatus according to claim 7, wherein said piston member moving distance restricting means is constituted by a stepped portion formed on an inner surface of said switch mechanism storage chamber in said inner space of said housing.

9. An apparatus according to claim 1, wherein said housing has a recess formed on its outer peripheral surface, and external projecting ends of said two terminal means are arranged in said recess.

10. An apparatus according to claim 9, wherein said recess, said switch mechanism storage chamber, and said pressure actuating chamber of said housing are aligned in a line, and said path and external projecting ends of said two terminal means extend in a direction parallel to the line.

11. A triple action pressure switch apparatus including first switch means which is set in one of ON and OFF states when a pressure of a pressurized fluid is set within a predetermined range, and is set in the other of the ON and OFF states when the pressure of the pressurized fluid is decreased below a lower limit of the predetermined range and is increased over an upper limit of the predetermined range, and second switch means which is set in one of the ON and OFF states when the pressure of the pressurized fluid is set to be larger than a predetermined value within the predetermined range, and is set in the other of the ON and OFF states when the pressure of the pressurized fluid is decreased below the predetermined value, comprising:

a housing having an inner space and a path for introducing the pressurized fluid into said inner space;

a diaphragm which is provided in said inner space so that said inner space of said housing is partitioned into a pressure actuating chamber communicating with said pressurized fluid introduction path and a switch mechanism storage chamber blocked from said pressurized fluid introduction path in a sealed state;

a first piston member which is arranged adjacent to said diaphragm in said switch mechanism storage chamber, and is moved together with a central portion of said diaphragm in a moving direction of said central portion when said central portion is moved upon movement of said diaphragm;

a second piston member which is arranged adjacent to said first piston member at a side farther from said diaphragm in said switch mechanism storage chamber, and is moved together with said first piston member in a moving direction of said first piston member when said first piston member is moved upon deformation of said diaphragm;

first snap disc means which is arranged adjacent to a side surface of said second piston member farther from said first piston member in said switch mechanism storage chamber, a peripheral portion of which is supported by a peripheral surface of said switch mechanism storage chamber so as not to be moved away from said diaphragm in the moving direction of said second piston member, and which is transformed with a snap action between a first configuration wherein its central portion projects toward said diaphragm to cause said second piston member to move close to said diaphragm and a second configuration wherein its central portion projects in a direction away from said diaphragm to cause said second piston member to be moved inwardly in the moving direction in said switch mechanism storage chamber, said first snap disc means being in the first configuration until the pressure of the pressurized fluid transmitted through said diaphragm and said first and second piston members reaches the upper limit of the predetermined range while the pressure of the pressurized fluid is increased, said first snap disc means being transformed from the first configuration to the second configuration when the pressure of the pressurized fluid has increased and reached the upper limit of the predetermined range, and when the pressure of the pressurized fluid is decreased after said first snap disc means was once transformed to the second configuration, said first snap disc means being transformed from the second configuration to the first configuration when the decreasing pressure of the pressurized fluid is decreased from the upper limit of the predetermined range by a further predetermined value; second snap disc means which is interposed between said second and first piston members, and is transformable with a snap action between a first configuration wherein its central portion projects toward said first piston member and a second configuration wherein its central portion projects in a direction away from said first piston member, said second snap disc means being in the first configuration until the pressure of the pressurized fluid transmitted through said diaphragm and said first piston member is increased from the lower limit of the predetermined range by a further predetermined value while the pressure of the pressurized fluid is increased, said second snap disk being transformed from the first configuration to the second configuration when the pressure of the pressurized fluid is further increased from the lower limit of the predetermined range by a further predetermined value, and when the pressure of the pressurized fluid is decreased after said second snap disc means is once transformed to the second configuration, said second snap disc means being transformed from the second configuration to the first configuration when the pressure of the pressurized fluid has decreased and reached the lower limit of the predetermined range;

third snap disc means which is interposed between said first piston member and said diaphragm and is transformable with a snap action between a first configuration wherein its central portion projects toward said diaphragm and a second configuration wherein its central portion projects in a direction away from said diaphragm, said third snap disc means being in the first configuration until the pressure of the pressurized fluid transmitted through said diaphragm reaches a predetermined value in the predetermined range while the pressure of the pressurized fluid is increased, said third snap disc means being transformed from the first configuration to the second configuration when the increasing pressure of the pressurized fluid has reached the predetermined value, and when the pressure of the pressurized fluid is decreased after said third snap disc means is once transformed to the second configuration, said third snap disc means being transformed from the second configuration to the first configuration when the pressure of the pressurized fluid is decreased from the predetermined value by a predetermined value;

a first actuating rod which is inserted in said second piston member and said first snap disc means to be movable in the moving direction of said second piston member and is moved in the moving direction upon transformation of said second snap disc means between the first and second configurations; and a second actuating rod which is inserted in said first piston member, said second snap disc means, said second piston member, and said first snap disc means to be movable in the moving direction of said first piston member, and is moved in the moving direction upon transformation of said third snap disc means between the first and second configurations;

wherein said first switch means has a pair of resilient switch segments which are arranged further inwardly from said first snap disc means in the moving direction of said first and second piston members in said switch mechanism storage chamber, are formed of an electrically conductive material, and are separated from each other in the moving direction, said pair of resilient switch segments of said first switch means are in contact with or separated from each other to be in one of the ON and OFF states until the pressure of the pressurized fluid is further increased from the lower limit of the predetermined range by the predetermined value while the pressure is increased, when the pressure of the pressurized fluid is increased from the lower limit of the predetermined range by the predetermined value and said second snap disc means is transformed from the first configuration to the second configuration, one of said pair of resilient switch segments is pressed by said first actuating rod which is moved inwardly in said switch mechanism storage chamber upon transformation of said second snap disc means, so as to be resiliently deformed, and one resilient switch segment which is resiliently transformed is separated from or in contact with the other resilient switch segment to set the other one of the OFF and ON states, when the pressure of the pressurized fluid is further increased over the upper limit of the predetermined range and said first snap disc means is transformed from the first configuration to the second configuration, said other resilient switch segment is pressed by one of the transformed first snap disc means and said second piston member which is moved inwardly in said switch mechanism storage chamber upon transformation of said first snap disc means, so as to be resiliently transformed, and said other resilient switch segment which is resiliently transformed is again in contact with or separated from said one resilient switch segment which has been already resiliently transformed to set said one of the ON and OFF states, when the pressure of the pressurized fluid is further decreased from the upper limit of the predetermined range by the predetermined value while the pressure of the pressurized fluid is decreased after said first snap disc means is transformed to the second configuration, said first snap disc means is transformed from the second configuration to the first configuration, so that said second piston member is allowed to be moved toward said diaphragm in said switch mechanism storage chamber, pressing of said other resilient switch segment by one of said first snap disc means and said second piston member is released, and said other resilient switch segment is separated from or in contact with said one resilient switch segment again to recover said other one of the OFF and ON states, and when the pressure of the pressurized fluid reaches the lower limit of the predetermined range while the pressure of the pressurized fluid is decreased after at least said second snap disc means is transformed to the second configuration, said second snap disc means is transformed from the second configuration to the firs configuration, so that said first actuating rod is allowed to be moved toward said diaphragm in said switch mechanism storage chamber, pressing of said one resilient switch segment by said first actuating rod is released, and as a result, said one resilient switch segment is again in contact with or separated from said other resilient switch segment to set said one of the ON and OFF states;

wherein said second switch means has at least one resilient switch segment which is arranged further inwardly from said first snap disc means in the moving direction of said first and second piston members in said switch mechanism storage chamber, and is formed of an electrically conductive material, said at least one resilient switch segment of said second switch means is set in one of the ON and OFF states when said third snap disc means is in the first configuration until the pressure of the pressurized fluid reaches the predetermined value in the predetermined range while the pressure is increased, when the increasing pressure of the pressurized fluid has reached the predetermined value and said third snap disc means is transformed from the first configuration to the second configuration, said at least one resilient switch segment is pressed by said second actuating rod which is moved inwardly in said switch mechanism storage chamber upon transformation of said third snap disc means, so as to be resiliently deformed, and said at least one switch segment which is resiliently transformed is set in the other one of the OFF and ON states, when the pressure of the pressurized fluid is further decreased from the predetermined value by a further predetermined value while the pressure is decreased after said third snap disc means is once deformed to the second configuration, and said third snap disc means is transformed from the second configuration to the first configuration, said second actuating rod is allowed to be moved toward said diaphragm in said switch mechanism storage chamber upon transformation of said third snap disc means and pressing of said at least one resilient switch segment by said second actuating rod is released, so that said at least one resilient switch segment is recovered to said one of the ON and OFF states; and wherein said first and second switch means are electrically connected to the other end of each of two terminal means whose one end projects outside said housing.

12. An apparatus according to claim 11, wherein said housing has a first housing portion having said pressurized fluid introduction path and said pressure actuating chamber, and a second housing portion having said switch mechanism storage chamber and detachably coupled to said first housing portion, and the peripheral portion of said diaphragm is fixed to a coupled portion between said first and second housing portions in a sealed state.

13. An apparatus according to claim 11, wherein said diaphragm is formed of a synthetic resin film.

14. An apparatus according to claim 11, wherein each of said first and third snap disc means is constituted by a plurality of snap discs concentrically stacked on each other.

15. An apparatus according to claim 11, wherein said pair of resilient switch segments of said first switch means are arranged to be separated from each other in the moving direction of said first and second piston members, said at least one resilient switch segment of said second switch means is arranged to be separated from said pair of resilient switch segments of said first means at a position farther from said first snap disc means than from said first switch means in the moving direction, said first actuating rod has an annular shape, and is inserted in a central portion of said first snap disc means to be movable in the moving direction, said second actuating rod has a rod-like shape, and is inserted in the central portion of said first piston member and in a central hole of said annular first actuating rod to be movable in the moving direction, and a through hole through which said first actuating rod is inserted is formed in one of said pair of resilient switch segments of said first switch means located near to said first snap disc means, and a through hole through which only said second actuating rod is inserted is formed in the other one of said pair of resilient switch segments located near to said second switch means.

16. An apparatus according to claim 11, wherein said second piston member has a high-pressure actuating projection which has an annular shape along the peripheral surface of said first actuating rod on the side surface of said second piston member located near to said first snap disc means, is inserted in said first snap disc means, and projects toward said pair of resilient switch segments of said first switch means, and when the pressure of the pressurized fluid has reached the upper limit of the predetermined range while the pressure of the pressurized fluid is increased, and said first snap disc means is transformed from the first configuration to the second configuration so that said second piston member is moved inwardly in said switch mechanism storage chamber, said high-pressure actuating projection of said second piston member presses said other one of said pair of resilient switch segment of said first switch to be in contact with or separated from said one resilient switch segment, thereby setting said other one of the ON and OFF states.

17. An apparatus according to claim 11, further comprising piston member moving distance restricting means, which abuts against said second piston member moved inwardly in said switch mechanism storage chamber upon transformation of said first snap disc means from the first configuration to the second configuration, so as to restrict a moving distance of said second piston member.

18. An apparatus according to claim 17, wherein said piston member moving distance restricting means is constituted by a stepped portion formed on an inner surface of said switch mechanism storage chamber in said inner space of said housing.

19. An apparatus according to claim 11, wherein said housing has a recess formed on its outer peripheral surface, and external projecting ends of said two terminal means are arranged in said recess.

20. An apparatus according to claim 19, wherein said recess, said switch mechanism storage chamber, and said pressure actuating chamber of said housing are aligned in a line, and said path and external projecting ends of said two terminal means extend in a direction parallel to the line.

* * * * *